United States Patent [19]

Voight

[11] Patent Number: 4,850,812

[45] Date of Patent: Jul. 25, 1989

[54] INTEGRATED MOTOR PUMP COMBINATION

[75] Inventor: Allan A. Voight, Geyserville, Calif.

[73] Assignees: Versatron Corporation, Healdsburg; F.P.I., Inc., Burbank, both of Calif. ; part interest to each

[21] Appl. No.: 98,457

[22] Filed: Sep. 18, 1987

[51] Int. Cl.[4] ..... F04B 1/20; F04B 35/04; H02K 7/14

[52] U.S. Cl. ..... 417/271; 417/357; 310/68 R

[58] Field of Search ..... 417/271, 356, 357, 366, 417/410, 419; 91/507; 310/68 R, DIG. 3

[56] References Cited

U.S. PATENT DOCUMENTS

| | | | |
|---|---|---|---|
| 2,161,143 | 6/1939 | Doe et al. | 91/507 |
| 2,741,990 | 4/1956 | White | 417/357 |
| 3,195,466 | 7/1965 | Young | 417/357 |
| 3,295,457 | 1/1967 | Oram | 417/271 X |
| 3,309,009 | 3/1967 | Culk | 417/357 |
| 3,347,168 | 10/1967 | Nixon | 417/357 X |
| 4,311,933 | 1/1982 | Riggs et al. | 310/68 R X |
| 4,529,362 | 7/1985 | Ichiryu et al. | 417/271 |
| 4,578,605 | 3/1986 | Reinhardt et al. | 310/68 R X |
| 4,729,717 | 3/1988 | Gupta | 417/271 X |

FOREIGN PATENT DOCUMENTS

| | | | |
|---|---|---|---|
| 2260506 | 6/1974 | Fed. Rep. of Germany | 417/271 |
| 614701 | 1/1961 | Italy | 417/419 |
| 43-18286 | 12/1968 | Japan | 91/485 |
| 81489 | 5/1985 | Japan | 417/356 |
| 236807 | 7/1925 | United Kingdom | 91/503 |

*Primary Examiner*—William L. Freeh
*Attorney, Agent, or Firm*—Henry M. Bissell

[57] ABSTRACT

An integrated motor pump unit for use as a hydraulic fluid pressure source at a remote location incorporates a pump rotor affixed in the center of a motor rotor. The motor/pump rotor assembly spins on a fixed shaft in a combination providing both radial journal and axial thrust bearings. The stationary shaft assembly incorporates a piston drive mechanism which is angled, relative to the shaft axis, so that reciprocal movement of the pistons is developed as they rotate about the axis. The fixed rotor shaft is axially adjustable to control the end clearance between the pistons and cam surfaces, and contains fluid flow galleries to the journal and thrust bearings. A magnetically permeable sleeve is mounted between the motor stator and rotor to seal the hydraulic fluid within the rotor space, thereby maintaining the stator windings and associated electronic circuitry in a dry environment. The combination functions as a servo pump under the control of an associated electronic motor controller unit and has the capability of providing variable flow directions and flow rates and pressures over a wide range for driving a hydraulic actuator or the like.

19 Claims, 3 Drawing Sheets

INTEGRATED MOTOR PUMP COMBINATION

BACKGROUND OF THE INVENTION

This invention relates to a system for driving hydraulic actuators from electronic control signals and, more particularly, to an integrated combination of an electric motor and hydraulic pump within a common housing.

One of the design objectives in the next generation of commercial, and possibly military, aircraft is the replacement of conventional hydraulic drive systems for hydraulic actuators which determine the positions of movable parts such as rudders, ailerons, elevators, landing gear and the like with remote electric motor/pump units located in the vicinity of the individual hydraulic actuators. Such a so-called "fly-by-wire" system is expected to provide substantial benefits for future aircraft in terms of reliability, weight reduction, control signal response, reduced cost, and simplification of the control systems.

The hydraulic control systems which have been used on larger aircraft for many generations have depended upon one or more engine driven hydraulic pumps and numerous hydraulic lines extending from the hydraulic pressure source via a central control mechanism in the cockpit to the various actuators in the wings, tail and body of the aircraft. These hydraulic systems have been prone to leak and have also been subject to operation problems resulting from old or contaminated hydraulic fluid, dirt or bubbles in the lines, pump failure, etc. There have even been occasions where aircraft have been lost because of a catastrophic hydraulic system failure.

It is considered that if electric motors and pumps for generating the required hydraulic pressure for the hydraulic fluid actuators are provided with the actuators on an individual basis, the elimination of the plurality of hydraulic lines extending from the cockpit to the various actuators and the need for a central hydraulic pressure source will bring about a substantial reduction in weight and the elimination of many of the problems now related to the conventional control system. The introduction of an electrical control system for the motor/pumps associated with the individual hydraulic actuators not only results in more effective control of the hydraulic actuators but also simplifies the task of transmitting the signals from the pilot's controls to the individual actuators.

The available space for a motor pump combination in the location of a hydraulic actuator on aircraft is somewhat limited, particularly in the locations of the actuators for ailerons and elevators. Therefore, it is preferred to utilize an integrated design in which the pump elements and motor housing are co-extensive with one another. Such designs are known in the prior art, one such being disclosed in U.S. Pat. No. 3,295,457 of Oram. The Oram unit comprises an electric motor, the rotor of which houses a plurality of cylinders with a piston in each cylinder, each piston having one end projecting from one end of the cylinder. The central shaft of the unit is fixed in position and the rotor, including the cylinders and pistons, rotates about the fixed central shaft. The unit contains an angled thrust plate, sometimes called a "swash" plate, which is fixed at an angle to the axis of the shaft and rotor. The projecting ends of the pistons are constrained to be maintained in sliding relationship with the thrust plate, thereby reciprocating within their cylinders as the cylinders rotate about the central shaft axis. This reciprocating motion of the pistons serves to pump the hydraulic fluid through the system.

This type of integrated motor pump design is not without its problems, however. Since the space within the unit in which the rotor rotates is filled with fluid, the electrical components of the motor may be subject to damage, particularly if the fluid being pumped is corrosive in nature, unless steps are taken to protect them from exposure to the hydraulic fluid. For the precise control required in the particular application of the invention which is described herein, some arrangement is required which provides precise angular control of rotor position to a higher degree than the Oram unit is capable of. Other improvements over like devices of the known prior art are also provided by the present invention.

SUMMARY OF THE INVENTION

In brief, arrangements in accordance with the present invention comprise a housing having a central portion with a plurality of fixed stator poles and a rotor which is mounted to rotate about a central fixed shaft. The rotor contains a plurality of magnetic driving elements and another plurality of reciprocating pump elements, all rotating concentrically about the shaft central axis and being situated substantially co-extensively along the shaft within the housing central portion. At one end of the rotor in one particular arrangement in accordance with the present invention, the shaft is shaped to provide an angled bearing surface which, in conjunction with an adjacent ball bearing member which is mounted along the shaft in a position adjacent the angled bearing surface to provide an angled bearing face which is related to the angled surface of the shaft portion, is effective to drive the reciprocating pump elements within their individual cylinders as the rotor assembly rotates about the fixed central shaft. The respective cylinders in the rotor are oriented parallel to the shaft axis, and each contains a reciprocating piston with a rod which extends outwardly from the cylinder toward the ball bearing face and has an enlarged head portion which rides between the angled bearing surface of the shaft and the corresponding face of the ball bearing to develop a reciprocating motion of the pistons as the cylinder and rotor assembly rotates about the shaft.

In an alternative embodiment, the angled bearing surface is provided by an apertured plate which is maintained at the desired angle for operation by a spacer member having an angled face which is mounted behind the plate. The spacer member is maintained stationary, affixed to the stationary central shaft by a roll pin, for example, while the apertured plate rotates with the rotor assembly, thereby developing the reciprocating motion of the pistons in cooperation with the angled ball bearing member.

At the end of the rotor remote from the ball bearing member is a floating port plate assembly. The port plate assembly is fixed against rotation but has a plurality of balanced pistons and a like plurality of auxiliary pistons alternately arrayed about the central shaft and intercoupled with fluid passages to carry the hydraulic fluid as it is pumped through the unit. The structure comprising the port plate and related balance pistons and auxiliary pistons is not a part of this invention, being known in the prior art. Suffice it to say that as the cylinders of the rotor rotate about the shaft, and while the pistons reciprocate back and forth therein, they come into registration with ports providing communication between the cylinders and the respective balance pistons and auxiliary balance pistons. These in turn reciprocate under the force of the fluid pressures developed within the cylinders to permit the fluid to flow into or out of a cylinder, depending upon the position of the piston therein relative to its stroke. The balance pistons and auxiliary balance pistons of the port plate assembly in turn connect with passages leading out of the port plate, to which lines connected to an associated hydraulic actuator may be connected so that the pumping action can in turn drive the hydraulic actuator as desired.

Surrounding the piston/cylinder portion of the rotor is a plurality of permanent magnets, elongated in the axial direction and equally spaced about the axis, to provide the rotational force for the rotor in response to electromagnetic fields which are generated in coil and pole piece structures comprising the stator surrounding the rotor in the central portion of the housing. This combination of electromagnetic stator poles and permanent magnetic rotor poles functions as a brushless DC motor. The magnets are held in place in the rotor by a surrounding magnetic retainer sleeve which rotates with the rest of the structure making up the rotor.

In addition to the elongated drive magnets spaced about the periphery of the rotor, a plurality of commutating magnets are situated near one end of the rotor in a circumferential configuration. Opposite these commutating magnets in alignment therewith are a plurality of Hall effect transducers which are utilized in adjacent commutation electronics circuitry to sense and develop signals indicative of the instantaneous angular position of the rotor.

A separating sleeve is provided between the rotor and the stator to prevent fluid which may leak from the pump elements and passages from reaching the electrical insulation on the stator winding and possibly seeping into other areas containing electronic components. In one particular embodiment of the invention, this separating sleeve is fabricated of a selected ceramic-carbon filament in a silicon carbide matrix-which is particularly effective in providing the desired separator effect without interfering with the magnetic interaction between the electromagnetic poles of the stator and the permanent magnets of the rotor. Other possible materials for this separator sleeve include other fiber-filled ceramics, non-magnetic metals such as stainless steel, electrically resistive metals such as titanium, fiber-filled plastics such as wound tubing, unfilled ceramics or plastics, or even low-resistance magnetic metals like steel.

The particular configuration of the housing and bell members is such that an effective seal against leakage is provided at each surface where the end bell members are joined to the housing central portion. The cylindrical construction adapts readily to the use of O-rings which are provided at both end portions of the housing where the ends are inserted along the interior surface of the stator sleeve. The end of the housing where the commutating magnets are located is configured to provide a relatively thin wall separating the commutating magnets, which rotate within the pump fluid, from the Hall effect transducers which are situated in a dry region of the unit. The housing and rotor configuration provides a central sealed cavity having no dynamic seals, such as rotating shaft seals, to the outside; there is thus a minimum possibility of any leakage from the pump cavity. The stator sleeve has only static seals and the pump is actuated by magnetic fields passing through the sleeve. The port plate end portion of the pump housing is affixed to one end of the stationary central shaft by means of a threaded nut and the parts making up the rotor assembly are held in place by an end cap which is retained by a second nut which is threaded onto the other end of the shaft. The end bell member in which the Hall effect transducers and the commutation electronics are mounted is affixed to the central stator portion of the motor pump assembly by a plurality of machine screws. The opposite end bell member, is similarly attached to the central portion of the stator housing. Connector plugs are provided for the commutation signal conductors and for the DC connections to the stator windings. Finally, a cover plate is affixed by screws to the outer face of the end bell portion bearing the commutation elements and electronics to complete the enclosure of the unit.

All rotating parts of the assembly are self-lubricating, utilizing the hydraulic fluid which is being pumped through the unit. The journal bearing by which the rotor rides on the central shaft contains passages through which the lubricating fluid is pumped as the unit operates. As an extension of the journal bearing passages, hydraulic fluid is directed along the piston extensions to the heads of the pistons where it is applied to the sliding surfaces against which the piston heads bear in their rotational, reciprocating motion.

BRIEF DESCRIPTION OF THE DRAWING

A better understanding of the present invention may be realized from a consideration of the following detailed description, taken in conjunction with the accompanying drawing in which.

DESCRIPTION OF THE PREFERRED EMBODIMENTS

Figure 1:
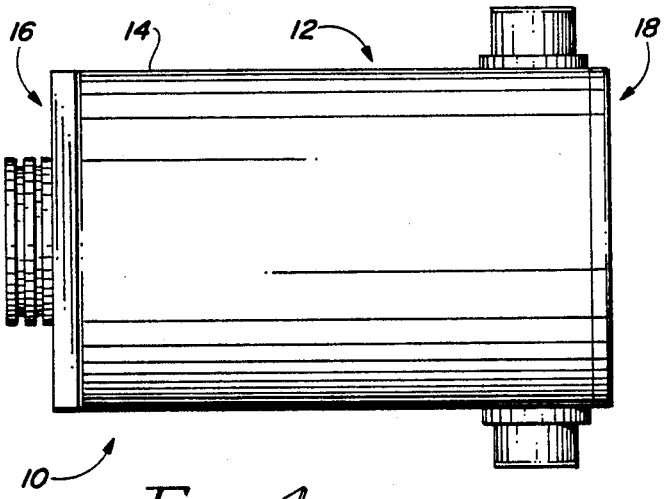
FIG. 1 is an outline drawing of the integrated motor pump in accordance with the present invention.

As depicted in the FIG. 1–4, the integrated motor pump assembly 10 of one embodiment of the present invention comprises a housing 12 having a main central portion 14 and left and right end bell members 16 and 18, respectively. A cover plate 20 is provided to enclose a recessed portion within the right-hand end bell member 18.

The main central portion 14 of the housing 12 encompasses both a stator 22 and rotor 24 making up a DC brushless motor 26 and a rotary pump 28 which is driven to rotate with the motor rotor 24. As is indicated in the schematic cross-sectional view of FIG. 3, the stator 22 comprises a plurality of magnetic pole pieces 30 and associated windings 32. The motor windings 32 are connected via leads 34 to a power plug connector 35 for the application of DC power to the motor. The motor rotor 24 comprises a plurality of permanent magnets 36 mounted for rotation about a central shaft 38 within the stator 22. The rotor 24 and stator 22 are separated by a sealing sleeve 40. The stator coils 32 and pole pieces 30 are positioned between a back iron section 44 and an insulating sleeve 42. The permanent magnets 36 are held in place by a magnet retaining sleeve 46 which comprises the outermost element of the motor rotor 24.

At the center of the motor pump assembly 10 and extending coaxially therewith is a fixed shaft 38. This shaft 38 is held against rotation by a number of pins or keys, such as 50, which orient the shaft within the left-hand end bell 16. The ends of the shaft 38 are threaded and a nut 52 is seated on the left-hand end, securing the shaft 38 within the end bell 16. The shaft 38 is hollow for part of its length, thus providing a fluid passage 54 which terminates in a plurality of radial ports 56 to provide lubrication for the journal bearing 58 of the pump rotor 28. The shaft 38 is machined to develop a radially extending cam portion 60 having an angled cam surface 62 which extends circumferentially around the shaft 38 at a selected angle relative to the axis of the shaft 38. The cam portion 60 has an auxiliary cam surface 64 which cooperates with the cam surface 62 in developing the reciprocating motion of the pump pistons as the rotor 28 rotates about the shaft 38.

Further along the shaft 38 is a canted ball bearing 70 which is mounted at an angle to the shaft which is related to the angle of the cam portion 60. The ball bearing 70 is held in position at the selected cant angle by a shaft end cap 74. The ball bearing 70 comprises two halves, a rotating half 71 which rotates with the pistons in the pump rotor 28 and a fixed half 72 which remains stationary against the end cap 74. The end cap 74 is held stationary with the shaft 38 by means of key 76 and a retaining nut 78 which is threaded on the right-hand end of the shaft 38.

Pumping of hydraulic fluid within the pump rotor 28 is effected by the reciprocating movement of a plurality of pistons 80 mounted to move back and forth in an axial direction, as indicated by the double ended arrows 82, within cylinders 84. Each piston 80 has an attached piston rod 86 which extends from the right-hand end thereof along the cam portion 60 of the shaft 38 to terminate in a mushroom-shaped head 88. The head 88 is formed with opposed beveled circumferential surfaces 90, 92 which mate respectively with the surfaces 62, 64 of the cam portion 60 and with the face of the rotatable half 71 of the ball bearing 70. Thus, each piston and rod assembly is constrained to reciprocate through a complete cycle of linear motion relative to its corresponding cylinder 84 for each complete revolution about the shaft 38.

At the left-hand end of each cylinder 84 is an opening 100 for communicating with corresponding openings or ports 102 and 104 in the port plate portion 101 of the end bell 16 when registration between these openings develops as the pump rotor 28 rotates. Openings 102 in the port plate portion 101 communicate with the cylinder of an auxiliary balancing piston 106 having an inlet passage 110. Ports 104 communicate with the cylinder of a balancing piston 112 having a central bore communicating with an outlet passage 114. These inlet passages 110 and outlet passages 114 extend by connecting passages (not shown) to couplings to hydraulic lines which are connected between an associated hydraulic actuator and the unit 10 through the end bell 16.

Figure 4:
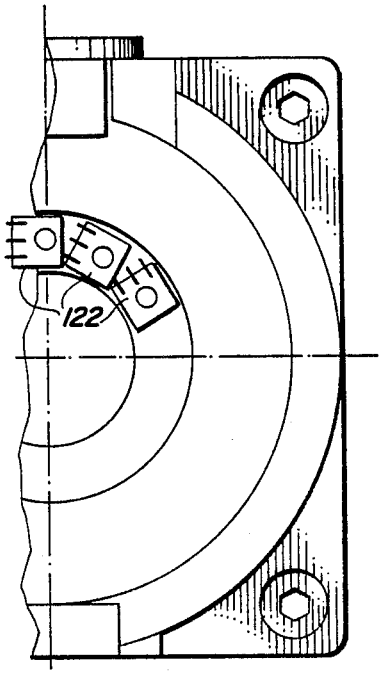
FIG. 4 is a schematic sectional view taken along the line 4—4 of FIG. 2.
Figure 3:
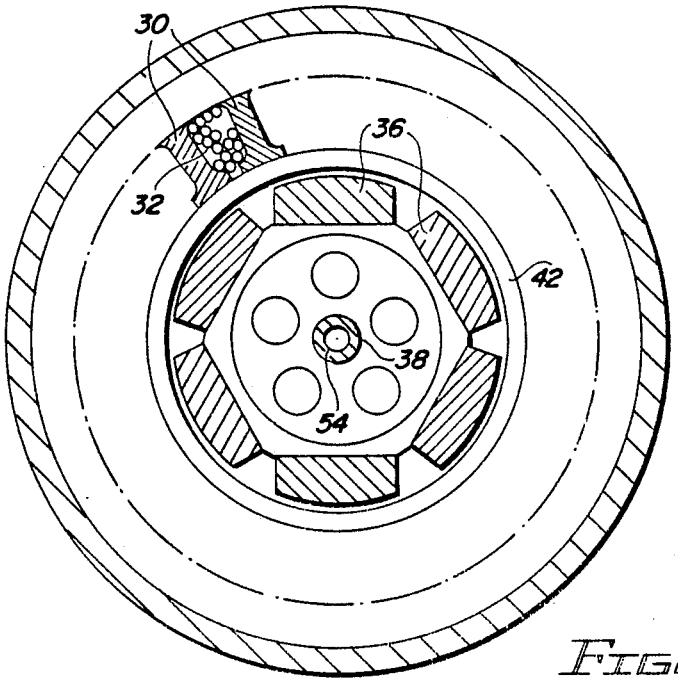
FIG. 3 is a schematic cross-sectional view taken along the line 3—3 of FIG. 2.

At the right-hand end of the motor rotor 24, to the right of the permanent magnets 36, is a plurality of commutating magnets 120. These are spaced circumferentially about the motor rotor 24 and are polarized in an axial direction. A corresponding plurality of Hall effect transducers 122, best shown in the schematic view of FIG. 4, are arrayed in circumferential positions corresponding to the commutating magnets 120 but on the opposite side of an intermediate partition portion 124 of the right-hand end bell member 18. These Hall effect transducers 122 are interconnected with the commutation electronics circuitry 126 to develop the desired indications of rotor angular position. Electrical connections to the commutation electronics 126 are provided by leads 128 which connect to a commutation signal connector 130 on the outside of the housing 12. The central region of the end bell member 18 in which the Hall effect transducers 122 and commutation electronics 126 are mounted is covered by an end plate 132, attached by mounting screws 134.

Figure 2:
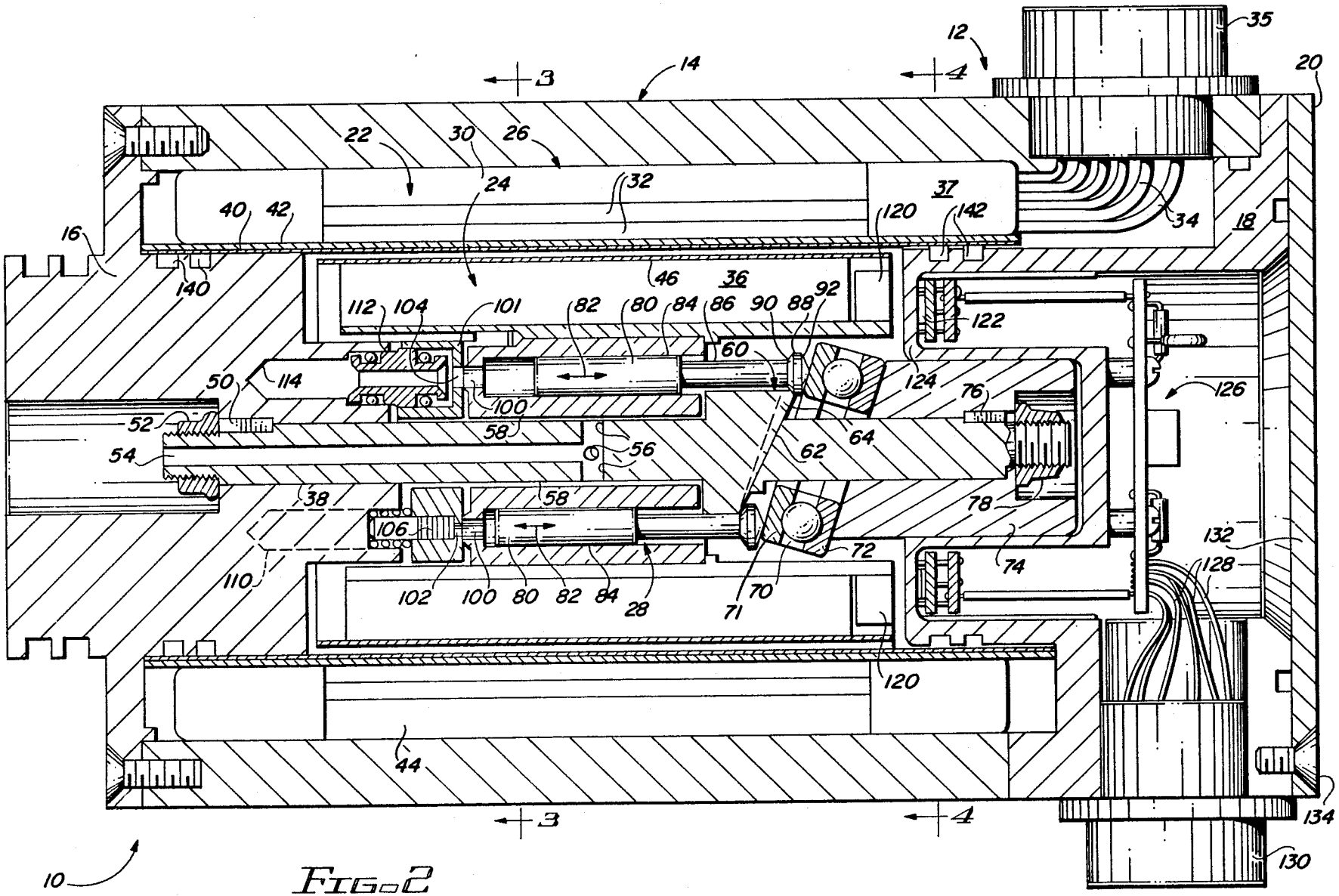
FIG. 2 is a half-sectional view of the embodiment depicted in FIG. 1.

The rotor 24/28 operates in a wet environment, the central portion of the housing 12 between the end bell members 16, 18 and radially inward of the separator sleeve 40 being filled with hydraulic fluid. This region is sealed against leakage by pairs of O-rings 140, 142 which extend circumferentially about the inwardly protruding portions of the end bell member 16, 18, respectively. With the unit assembled as indicated in FIG. 2, the only mating surfaces along which hydraulic fluid might escape are those between the respective end bells 16, 18 and the separator sleeve 40, and these are adequately sealed against leakage by the O-rings 140, 142.

Figure 5:
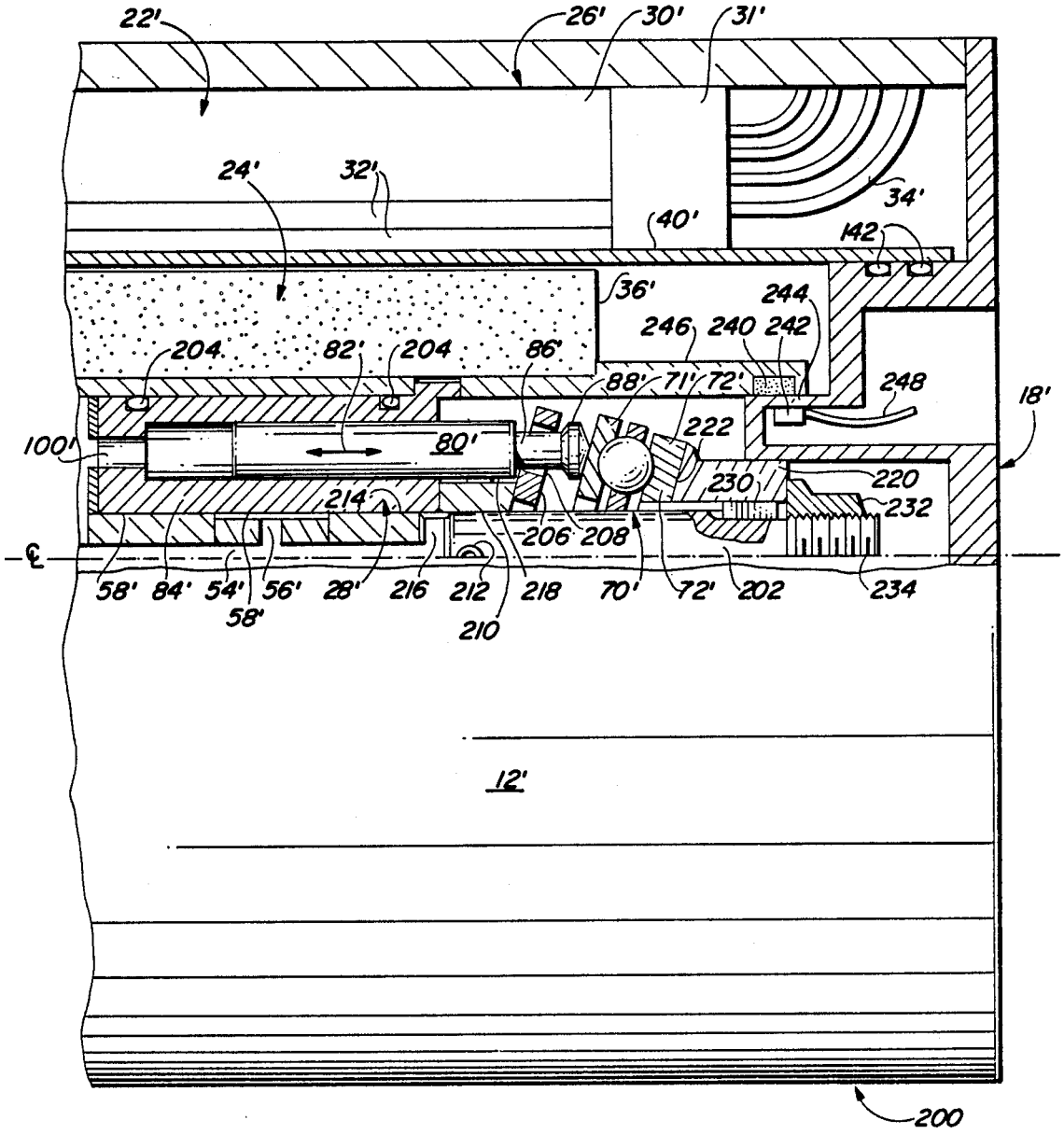
FIG. 5 is a quarter-sectional view of a portion of an alternative arrangement in accordance with the present invention.

An alternative, preferred embodiment of the present invention is represented in the cross-sectional view of FIG. 5. In this figure, a portion of the right-hand end of a motor pump 200 is represented in quarter-section. The motor pump assembly 200 of FIG. 5 is similar in many respects to the motor pump assembly depicted in FIGS. 1–4, and like elements of motor pump assembly 10 of FIGS. 1–4 are given like reference numerals in FIG. 5, with the addition of a prime superscript. Thus, the motor pump 200 is shown comprising, within a housing 12', a stator 22' and rotor 24' of brushless DC motor 26'. Contained within the motor 26' is a rotary pump 28' having pistons 80' mounted for reciprocal motion within cylinders 84' which are positioned within the pump rotor 28' mounted to rotate about a fixed, stationary shaft 202. The assembly is provided with a canted ball bearing 70' including a thrust plate 71' which rotates about the shaft 202 with the pistons 80' and drives the expanded piston heads 88' to develop a reciprocating piston motion. As with the embodiment 10, the shaft 202 is provided with a central bore 54' and radial passages 56' to transmit pump fluid to journal bearing surfaces 58' for lubrication of the journal bearing between the pump rotor 28' and the shaft 202.

The motor stator 22' comprises stator winding coils 32' and stator pole pieces 30'. The stator end turns are indicated by the block 37' and leads to the stator windings are indicated by the block 34'. The motor rotor 24' comprises a plurality of permanent magnets 36' which are affixed to the pump rotor 28' in the manner described for the embodiment 10 of FIGS. 1–4. O-ring seals 204 are positioned about the outer periphery of the cylinder barrel 84'. A sleeve 40' is provided to separate the space containing the rotating assembly from the stationary stator 22' so that, while the rotating parts may operate in a wet environment for ease of lubrication and simplification of pump construction, all of the electrical and electronic components including the stator windings 32 and connecting leads 34' as well as the control electronics are maintained in a dry environment, protected against leakage of the possibly corrosive hydraulic fluid of the motor pump 200 by the sleeve 40' and O-ring end seals 142'.

In the preferred embodiment of the invention as depicted in FIG. 5, reciprocating movement of the pistons 80' is controlled by an apertured return plate 206 operating in cooperation with the thrust plate 71' of the ball bearing 70'. The return plate 206 contains a plurality of openings 208, one for each piston 80', through which the necked-down piston extensions 86' extend. In assembling the motor pump 200, the pistons 80' are slipped through the openings 208 in the return plate 206 before being inserted in the cylinders 84'. A return bearing 210 is mounted in a fixed position on the shaft 202 by means of a roll pin 212. This forms a thrust bearing surface 214 with the end surface of the rotor 28' which finds lubrication by hydraulic fluid transmitted from the central bore 54' via radial passages 216. An annular space 218 about the return bearing 210 serves to carry fluid the angled surface at the right-hand end of the return bearing 210 to provide lubrication where this surface is contacted by the adjacent surface of the rotatable return plate 206.

The shaft and rotor assembly of the motor pump 210 further comprises an end bell cam 220 having an angled face 222 for establishing the angle of the stationary race 72' of the canted ball bearing 70'. The end bell cam 220 is keyed to the shaft 202 by a shaft key 230. The assembly is completed by a retaining, self-locking nut 232 screwed onto the threaded end portion 234 of the shaft 202.

In this embodiment of the invention, the coupling between commutating magnets 240 and Hall effect transducers 242 is effected through a thin axial shell portion 244 of the right-hand end bell 18'. Thus, the commutating magnets 240 are oriented axially in a cylindrical magnet mounting member 246 which extends axially from the rotor 24'. Likewise, the Hall effect transducers 242 are oriented axially, mounted on the exterior surface of the thin shell portion 244 of the end bell 18'. Leads from the Hall effect transducers 242 are indicated at 248. The remaining electronics of the motor pump 200 are as indicated in the arrangement of FIG. 2, but have been omitted from FIG. 5 for simplicity of illustration. The pump portion to the left of the preferred embodiment illustrated in FIG. 5 is like the embodiment of FIGS. 1–4 and is known in the art.

Thus, arrangements in accordance with the present invention provide an extremely effective, operative motor pump assembly which is essentially leak-proof, is self-lubricating at all bearing surface, and which combines an electric drive motor and associated pump mechanism in a very compact unit by virtue of the installation of the pump within the core of the drive motor. With the constructions which have been shown and described, the assembly of the respective parts into a complete unit is relatively easy to accomplish, and a simple, rugged, reliable integral motor pump results which is economical to build and very lightweight compared with known prior alternatives, thus providing an improved apparatus for the use intended. The construction of the pump with the magnetically permeable sleeve between the stator and the rotor which is mounted on a stationary shaft establishes a sealed rotor cavity having no dynamic seals, such as rotating shaft seals, to the outside. The sleeve has only static seals which maximize protection against leaks.

Although there have been described above specific arrangements of an integrated motor pump combination in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An integral motor pump combination comprising:

an axial-piston pump of the swash-plate type having a rotor containing a plurality of axially oriented cylinders and pistons which is mounted for rotation about a stationary shaft;

a brushless direct current motor having an electromagnetic stator mounted within a housing and a rotor including a plurality of permanent magnets spaced circumferentially about the longitudinal axis of said shaft, the magnets being mounted to the pump rotor to drive the pump rotor rotationally about said shaft;

means mounting the pump rotor, the motor rotor and the motor stator concentrically and generally axially coterminously of each other within said housing;

sealing means positioned between the motor rotor and the stator to prevent fluid driven by the pump from reaching the electrical circuitry associated with the electromagnetic stator;

an angled thrust plate rotatably mounted on said shaft for bearing against said pistons to develop reciprocal motion thereof during rotation of the pump rotor;

return means coupled to said pistons to cause said pistons to bear against said thrust plate during rotation of the pump rotor, said return means comprising an apertured return plate having means defining openings engaging respective necked-down portions of said pistons for urging the pistons into contact with said thrust plate throughout their rotation about the shaft; and a return bearing affixed to said shaft against rotation and having an angled bearing surface for supporting the return plate at a predetermined angle during rotation thereof about said shaft.

2. The combination of claim 1 wherein the sealing means comprise a cylindrical sleeve positioned radially inward of the stator and generally coterminous therewith, the sleeve surrounding the motor rotor and being spaced radially outward therefrom.

3. The combination of claim 1 wherein said return means further comprise a radially outwardly directed section of said stationary shaft having an angled cam surface for biasing the pistons outwardly into contact with said thrust plate throughout their rotation.

4. The combination of claim 1 further including an adjustable end cam member affixed to an outer end of said shaft against rotation and having a canted surface established at a predetermined angle for supporting a roller bearing including said thrust plate as a rotatable element thereof.

5. The combination of claim 1 further including a hollow bore within at least a portion of said shaft communicating at one end with fluid passages of said pump and further including a plurality of radially directed ports extending from said bore to the outer surface of the shaft for transmitting lubricating fluid to bearing surfaces between rotatable and stationary elements of said combination.

6. The combination of claim 5 wherein said bore and radial ports serve to provide lubricating fluid for both journal bearing and thrust bearing surfaces of the combination.

7. The combination of claim 1 wherein the housing includes opposed end bell members mounted to close opposite end portions of the housing, each end bell member having an inwardly extending cylindrical section overlapping within an adjacent end portion of the sleeve, and annular sealing means positioned between each end bell cylindrical section and an adjacent sleeve end portion for preventing leakage of fluid past the end of the sleeve.

8. The combination of claim 7 wherein said sealing means further comprise O-rings positioned in circumferential recesses in corresponding end bell sections to bear against an inner surface of the adjacent end portion of the sleeve.

9. The combination of claim 7 further including a plurality of commutating magnets mounted for rotation with the motor rotor and positioned adjacent an inner wall surface of one of the end bell members, and a plurality of electrical transducers mounted circumferentially along an outer wall surface in alignment with the commutating magnets for coupling thereto.

10. The combination of claim 9 wherein said transducers are of the Hall effect type, and further including circuit control electronics and electrical connecting leads associated therewith for controlling operation of the integral motor pump.

11. The combination of the claim 9 wherein said commutating magnets and transducers are mounted in respective parallel planar configurations oriented generally orthogonally to the longitudinal axis of the combination.

12. The combination of claim 9 wherein the commutating magnets and electrical transducers are mounted with the commutating magnets being spaced circumferentially about the transducers, the commutating magnets and the transducer facing each other on opposite sides of a cylindrical portion of one of the end bell members.

13. The combination of claim 8 wherein the sleeve comprises a fluid impervious, magnetically permeable material.

14. The combination of claim 11 wherein said material comprises a low-resistance magnetic metal.

15. The combination of claim 13 wherein said material comprises carbon filament in a silicon carbide matrix.

16. The combination of claim 13 wherein said material comprises a fiber filled ceramic.

17. The combination of claim 13 wherein said material comprises a non-magnetic metal.

18. The combination of claim 17 wherein said metal is stainless steel.

19. The combination of claim 17 wherein said metal is titanium.

* * * * *